US005196676A

United States Patent [19]

Hallahan

[11] Patent Number: 5,196,676

[45] Date of Patent: Mar. 23, 1993

[54] OVEN UNIT FOR HEAT TREATING SEALANT MATERIAL

[75] Inventor: Michael A. Hallahan, Butler, Pa.

[73] Assignee: Billco Manufacturing, Inc., Zelienople, Pa.

[21] Appl. No.: 874,411

[22] Filed: Apr. 27, 1992

[51] Int. Cl.[5] ..... F27B 9/06

[52] U.S. Cl. ..... 219/388; 392/416; 392/424; 219/405

[58] Field of Search ..... 219/388, 405, 411; 392/408, 416, 423, 424, 425; 34/4, 39

[56] References Cited

U.S. PATENT DOCUMENTS

| | | | |
|---|---|---|---|
| 2,820,131 | 1/1958 | Kodama | 219/388 |
| 3,239,651 | 3/1966 | Silberman | 219/388 |
| 4,389,562 | 6/1983 | Chaudoir | 219/388 |
| 4,391,663 | 7/1983 | Hutter | 156/64 |
| 4,397,451 | 8/1983 | Kinoshita | 219/388 |
| 4,406,944 | 9/1983 | Crain | 219/388 |
| 4,540,876 | 9/1985 | McGinty | 219/405 |
| 4,820,365 | 4/1989 | Brumm | 156/109 |
| 4,968,871 | 11/1990 | Hamrin | 392/424 |

*Primary Examiner*—Teresa J. Walberg

*Attorney, Agent, or Firm*—George C. Atwell

[57] ABSTRACT

An oven unit for heat treating sealant strip material applied to the perimeter edges of a window unit includes an oven box having a pair of spaced-apart sidewalls and an upstream end for receiving the window unit and a downstream end for egress of the window unit after heat treating. The window unit is conveyed through the oven box by a plurality of rollers extending between each sidewall and arranged from the entrance end to the exit end. Interspersed among the rollers and located immediately adjacent and below the window unit are a plurality of lower emitters for generating and directing radiant heat energy upon the sealant strip material. An upper row of spaced-apart emitters also directs radiant heat energy upon the sealant material. Interspersed among the upper row of emitters are a plurality of removably insertable reflector housings with each reflector housing having mounted therein a cambered, removably insertable, heat reflective panel adapted to reflect and redirect radiant heat energy upon the sealant material for facilitating the heat treating thereof. The oven unit also includes a damper system to permit convective heat flow within the oven box to the atmosphere.

19 Claims, 8 Drawing Sheets

OVEN UNIT FOR HEAT TREATING SEALANT MATERIAL

BACKGROUND OF THE INVENTION

The present invention relates to heating devices, and more particularly pertains to oven units for heat treating sealant strip material applied to the perimeter edges of window units, either single-, double-, or triple-pane window units, by utilizing emitters which generate and direct radiant heat energy upon the sealant strip material.

A critical step in the production of window units is the heat treating of sealant strip material that is applied to the perimeter edges of the window unit. As double- and triple-pane windows predominate the marketplace, the sealant strip material, the most common kind being polyisobutylene, also known as butyl hot melt, or a swiggle strip material, is utilized as an adhesive for securing each window pane in spaced, parallel relationship to one another and also for providing a thermal and moisture insulative barrier between the sash and the panes of glass. The hermetic seal achieved by the sealant strip material prevents moisture seepage from the exterior atmosphere through the frame and the metal spacers, located on the inside perimeter of the window panes, into the enclosed region within the window panes, thus preventing fogging of the interior of the window unit through condensation. In addition, the hermetic adhesion of the sealant strip material to the perimeter edges of the window unit prevents conductive heat loss from the interior of the dwelling through the window unit to the external environment. The process of heat treating and curing the sealant strip material plays a critical role in the production of multi-pane window units that have a high R value and a low E (emissivity) value.

The prior art discloses a number of devices for curing an adhesive material applied to the perimeter edges of a workpiece. For example, the Hutter, III patent, U.S. Pat. No. 4,391,663, discloses a plurality of upright electrical-powered radiation heaters for generating radiation heat energy. The workpiece to be treated is a plurality of window or door units stacked vertically upright in a movable cart. The cart is placed close to the radiation heaters so that the adhesive substance placed along the perimeter edge of each door or window unit receives the radiation heat energy generated by the heater. The heaters themselves are positioned on two of the four sides of the door or window unit.

The Crain, et al. patent, U.S. Pat. No. 4,406,944, discloses an infrared furnace including a pair of opposed sidewalls which have a plurality of aligned ceramic holders located thereon. In addition, a plurality of spaced-apart quartz tubes extend longitudinally through the infrared furnace and support an endless conveyor belt thereon.

The McGinty patent, U.S. Pat. No. 4,540,876, discloses a rectangular chamber for heat treating electronic components and integrated circuits. The furnace includes six plain reflecting walls and two sets of heat radiation lamps, the second set of heat radiation lamps spaced apart from and parallel to the first set of heat radiation lamps.

The Brumm, et al. patent, U.S. Pat. No. 4,820,365, discloses a method and apparatus for a glass edge sealant curing system. The apparatus includes a conveyor for conveying a stack of window units coated with an edge sealant material and a heater assembly with infrared heating units placed back-to-back at a midpoint on the conveyor.

Despite the ingenuity of the foregoing devices, there remains a need for an oven unit which utilizes radiant heat energy generating emitters having a rapid response time for generating maximum heat energy and an equally rapid response time for cooling down. In addition, there is a need for an oven unit wherein the emitters are quickly and easily insertable and removable as well as vertically adjustable to accommodate different thicknesses of window units. Furthermore, there remains a need for an oven unit which utilizes a maximum amount of reflected radiant heat energy for heat treating the sealant material applied to the window unit being conveyed therethrough.

SUMMARY OF THE INVENTION

The present invention comprehends an oven unit for treating material applied to the perimeter edges of a workpiece in order to effect the hermetic sealing and adhesion of the material to the perimeter edges thereof. More specifically, the oven unit of the present invention is utilized in the application of radiant heat energy upon sealant strip material applied to the perimeter edges of multi-pane window and door units. The sealant strip material provides a moisture hermetic adhesion between the panes of glass of the window unit as well as firmly securing the panes of glass in a spaced, parallel relationship to each other. In addition, the oven unit can be utilized in heat treating coatings on a variety of substrates including metals, wood products, plastics, fabrics, ceramics, glass, and paper. The oven unit of the present invention may be a stand-alone unit, or may be attached in-line to other equipment, such as, for example, to an oven press unit for further processing of the window units.

The oven unit of the present invention includes an oven box which can be either square-shaped or rectangular-shaped. The oven box includes a pair of opposed, vertical, spaced-apart sidewalls and a pair of electric box housings to which is hingeably attached an electric box cover so that the interior of the oven box may be exposed for repair, maintenance, or inspection. Each sidewall covers an insulation block extending substantially the same length along the side of the oven box as each sidewall. Each insulation block includes one row of aligned, spaced-apart through-holes extending along the length of the block thereof, and the insulation blocks are adapted to prevent convective heat flow outward from the oven box. The oven box includes an upstream entrance end for receiving the horizontally-disposed window unit and a downstream exit end for egress of the window unit after subjection to the heat treating process. A conveyance means, which includes a plurality of spaced-apart rollers extending between each sidewall and successively arranged from the entrance end to the exit end of the oven box, conveys the window unit in a linear and horizontal path through the oven box.

Located above the rollers and the window unit being linearly conveyed therealong are a plurality of spaced-apart, horizontally-disposed, removably insertable, reflector housings. The reflector housings extend between each sidewall of the oven box and are attached to structural components positioned above and extending substantially the same length as the sidewalls. The reflector housings extend transverse to the linear path of the workpiece and the ends of the reflector housings are adjacent and above each sidewall. Slidably disposed within each reflector housing is a cambered, heat reflective panel. The reflective panels are adapted to reflect radiant heat energy upon the sealant material applied to the workpiece as it is conveyed through the oven box to facilitate heat treating of the sealant material. The panels are adapted for removable insertion into each respective reflector housing, and the cambered shape of each reflective panel is maintained by the slidable mounting of each panel within each respective reflector housing. The reflective panels may be constructed from any polished surface: highly polished, flexible, aluminum-clad steel being one material.

In order to achieve an airtight seal within the window unit and a moisture hermetic adhesion between the panes of glass of the window unit and the sealant material, radiant heat energy is applied to the sealant material as it is being linearly and horizontally conveyed through the oven box. The oven unit of the present invention utilizes a plurality of removably insertable, elongated emitters for generating the radiant heat energy necessary for bonding the sealant material to the window panes to attain an airtight adhesion and moisture hermetic seal between the sealant strip material and the panes of glass of the window unit. The emitters particularly suitable in this application are of the infrared type which produce radiant heat energy in the short wavelength region of the infrared spectrum.

More specifically, the emitters are characterized by a lower row of emitters interspersed among the rollers and extending between each sidewall transverse to the linear path of travel of the window unit. The lower row of emitters are positioned immediately adjacent and below the workpiece being conveyed therealong at an optimum distance of approximately one-half inch from the linearly conveyed window unit. In addition, an upper row of emitters are interspersed among the spaced-apart reflector housings, and are positioned immediately above and adjacent the workpiece being conveyed through the oven box. The upper row of emitters extend between each sidewall transverse to the path of the window unit. The upper and lower rows of emitters have their ends projecting a short distance through each opposed sidewall. The emitters generate the radiant heat energy for heat treating the sealant strip material deposited along the perimeter edge of each window unit. Both the upper and lower rows of emitters are adapted to be vertically adjustable to or away from the window unit being conveyed through the oven box in order to accommodate window or door units of various thicknesses.

In order to vent some of the ambient heat produced by the heat emitters within the oven box, the oven unit of the present invention employs a venting means for dissipating radiant heat within the oven box and for permitting convective heat flow therefrom. The venting means includes a damper system characterized by a lower flat sheet member positioned atop and covering the oven box and having a plurality of damper holes for permitting heat to escape therethrough. Also, the damper system includes a flat upper member having a plurality of vent holes, the flat upper member positioned atop and covering the oven box, and, more specifically, slidably disposed superjacent the lower flat sheet member so as to selectively cover or uncover the damper holes of the lower flat sheet member to vent heat to the atmosphere. The lower flat sheet member is larger than the flat upper member and the diameter of the damper holes and the vent holes would be the same. The damper system of the present invention is manually operated; however, the automatic regulation of the ambient heat within the oven box by computer-controlled sensors is another alternative. Disposed beneath the rollers and the lower row of emitters, and having substantially the same width as the rollers and extending from the entrance end to the exit end of the oven box, is a lower reflector pan for reflecting radiant heat generated by the emitters back onto the sealant strip material. The reflector panels and the lower pan are adapted to reflect radiant heat energy generated by the emitters onto the sealant strip material for facilitating the maximum heat treating and curing of the material.

At least one thermal heating probe is mounted atop the oven unit and projects downwardly into the oven box. By visually checking the thermal heating probe, the operator can constantly monitor the internal temperature within the oven box and can take appropriate steps to increase or decrease the internal temperature as necessary. The oven unit of the present invention also includes an insulative member disposed on each roller for reflecting radiant heat energy generated by the emitters onto the sealant strip material as the window unit is being conveyed therethrough. The insulative members are snugly and completely wrapped around or slipped onto each respective roller for providing both a smooth surface upon which the window unit can travel and also an insulative barrier between the rollers and the window unit. Furthermore, each insulative member has a reflective surface which reflects radiant heat energy onto the sealant material for heating and curing the material.

It is an objective of the present invention to provide heating emitters having a rapid response time to attain maximum heating temperature and an equally rapid cool-down time, and which are extremely durable.

It is another objective of the present invention to provide structural components, such as the emitters, the reflector housings, and the reflective panels, which are removably insertable within the oven unit for easy and quick maintenance, repair, and inspection.

Yet another objective of the present invention is to provide an oven unit having a modular design so that the number and positioning of various structural components, such as the emitters and the reflector housings, can be altered to meet specific user requirements.

Still another objective of the present invention is to provide a highly energy efficient oven unit utilizing less power but more efficient in generating radiant heat energy to heat treat and cure the material applied to the door or window unit.

Other features and advantages of the present invention will become apparent from the following detailed description, taken in conjunction with the accompanying drawings which illustrate, by way of example, the principles of the invention.

DETAILED DESCRIPTION OF THE PREFERRED EMBODIMENT

Figure 1:
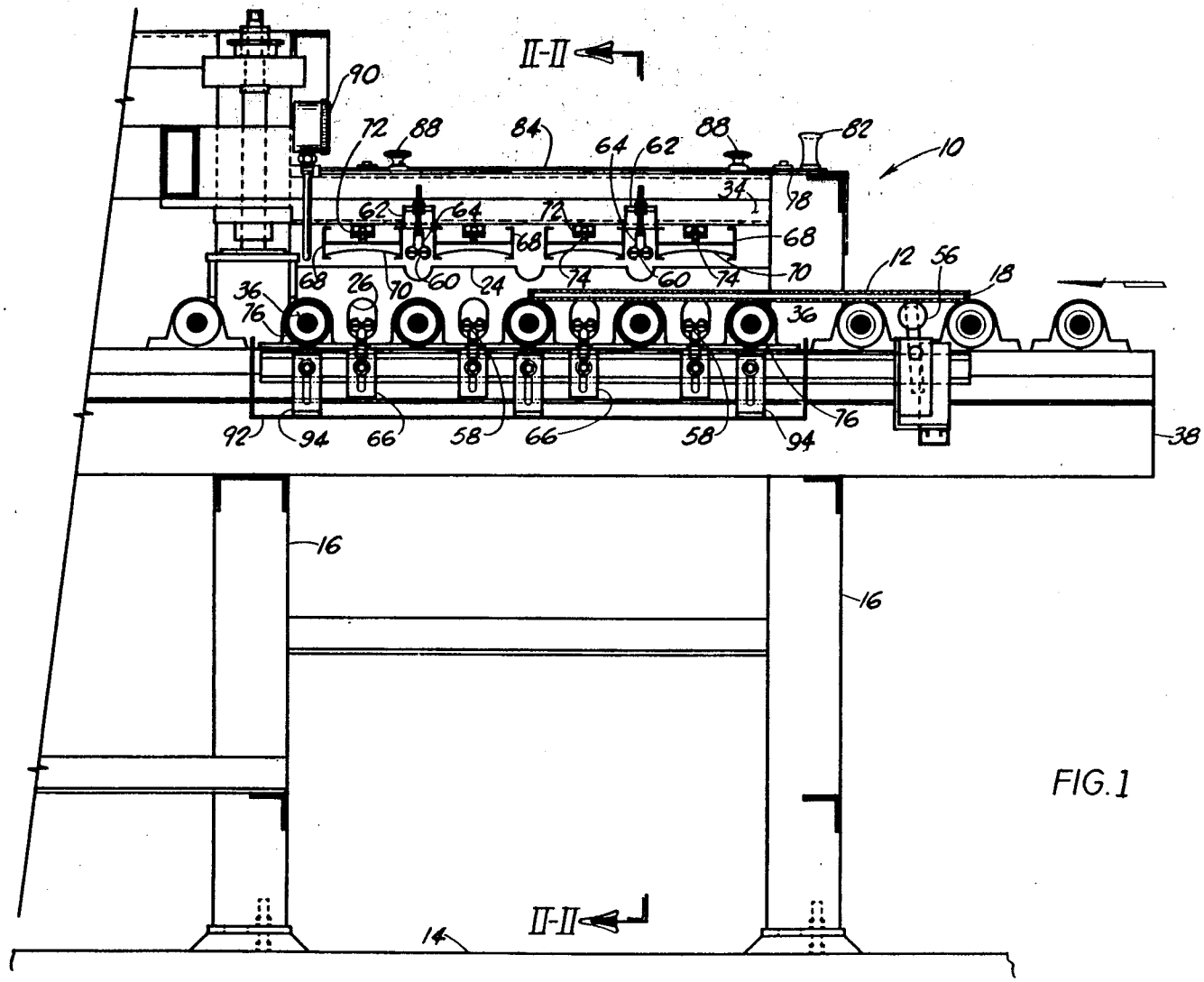
FIG. 1 is a longitudinal cross-sectioned view of the oven unit of the present invention taken along Lines I—I of FIG. 2.

FIGS. 1-7 illustrate an oven unit 10 for heat treating a workpiece 12 horizontally disposed for conveyance in a linear path through the unit 10. The unit 10 is placed on a level floor surface 14 and mounted on a plurality of upright, spaced-apart, main frame members 16. The workpiece 12 which is treated by the unit 10 is typically a single-, double-, or triple-pane insulated window or door unit, with an adhesive substance 18 applied in a single continuous line about the outer perimeter edge thereof. The adhesive substance 18 may be various kinds of sealant strip material, such as polyisobutylene, also known as butyl hot melt, or a swiggle strip material which comes in large rolls and is applied by a hand-held applicator to the perimeter edges of the window unit. A corrugated metal or aluminum piece is embedded within the sealant strip material to give it structural integrity. In addition, the unit 10 can be utilized in heat treating coatings on a variety of substrates including metals, wood products, plastics, fabrics, ceramics, glass, and paper. The unit 10 is usually placed in line with other processing equipment such as an oven press unit, and the various units may alternate in a production line with an oven unit feeding into an oven press, followed immediately by another oven unit, and then an oven press. The heating and curing of the sealant strip material would be accomplished in each oven heating unit and then the window unit would be fed into the oven press unit. The window unit would be linearly conveyed through a plurality of spaced-apart upper and lower rollers for pressing the panes of glass together in order to facilitate adherence of the sealant material to the panes of glass of the window unit.

Figure 2:
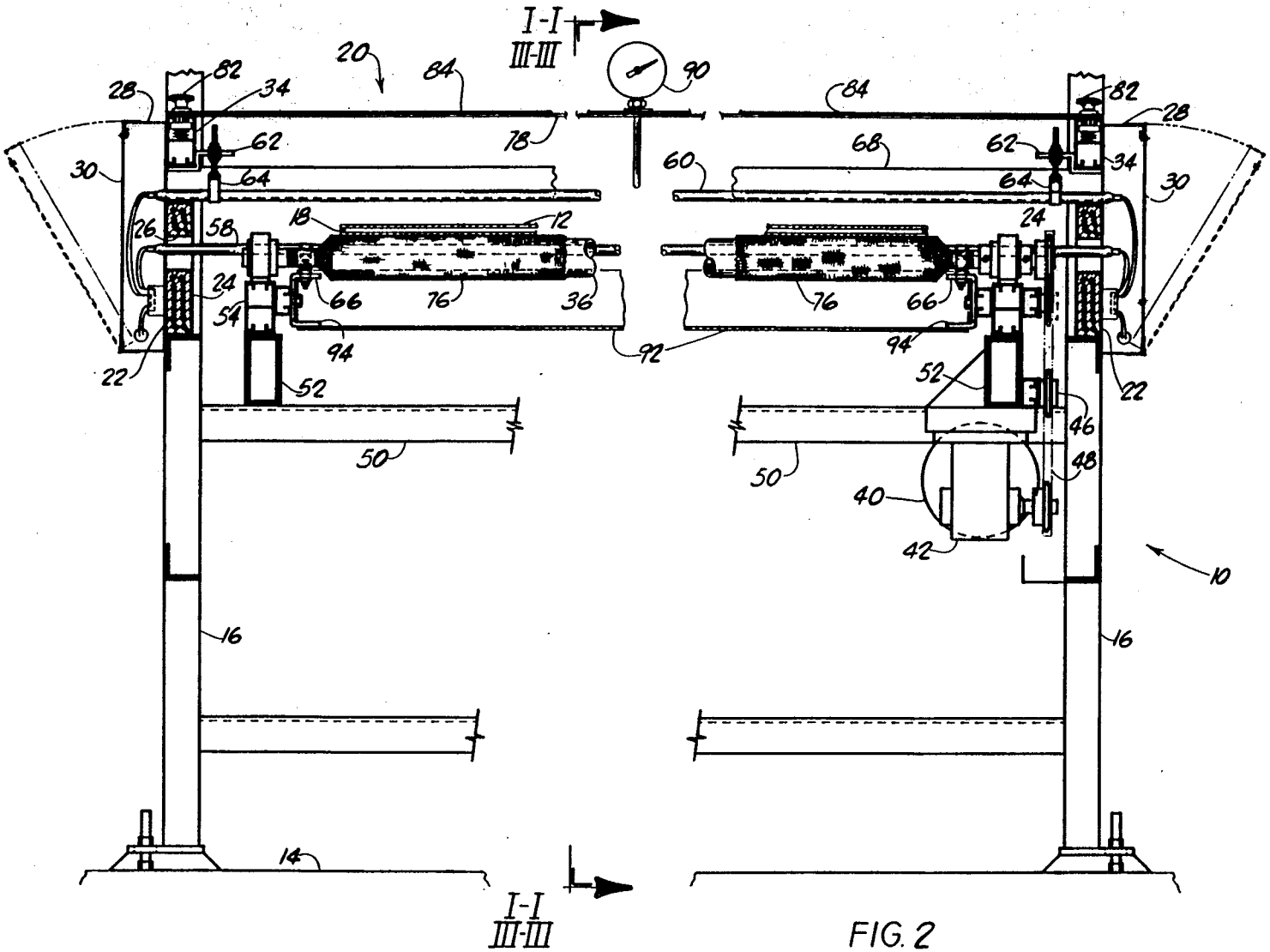
FIG. 2 is a cross-sectioned view of the oven unit taken from the entrance end along Lines II—II of FIG. 1.

The unit 10 includes an oven box 20, either square-shaped or rectangular-shaped. The oven box 20 includes an upstream entrance end where the workpiece 12 is fed into the oven box 20 and a downstream exit end for egress of the workpiece 12 after heat treating therein. The entrance end and the exit end need only be rectangular apertures equal in width to the oven box 20 through which the workpiece 12 can be conveyed. The oven box 20 also includes a pair of opposed, spaced-apart, upright, vertical sidewalls 22. Each sidewall 22 includes a plurality of spaced-apart apertures arranged along the length of each sidewall 22. Each of the apertures in one sidewall 22 is directly opposite and corresponds to each respective aperture in the opposite sidewall 22. Each sidewall 22 includes insulation block material 24 that may be up to one and one-half inches thick; in fact, as shown in FIGS. 1 and 2, the lower portion of each sidewall has a substantial backing of insulation block material 24. Each block 24 includes a row of spaced-apart insulation block holes 26. FIG. 2 illustrates one pair of opposed holes 26 extending through each insulation block 24 and in alignment with a respective aperture of each sidewall 22. In addition, FIG. 2 illustrates an electric box housing 28 mounted to each sidewall 22 with an electric box cover 30 hingeably attached to each housing 28. Each cover 30 encloses each housing 28 and extends the length of the oven box 20. Each cover 30 is hingeably mounted so that upon being opened by the operator or workman, the respective cover 30 will pivot downward toward the operator. The covers 30 enclose electrical structural components of the unit 10 and also allow operator maintenance and replacement of structural elements which are located within the oven box 20 and will be described hereinafter. To close each cover 30, the operator simply swings it upward and snaps it back into place. A pair of spaced-apart, padded handles 32 are mounted to each cover 30 for operator safety and ease in opening and closing the covers 30.

Figure 3:
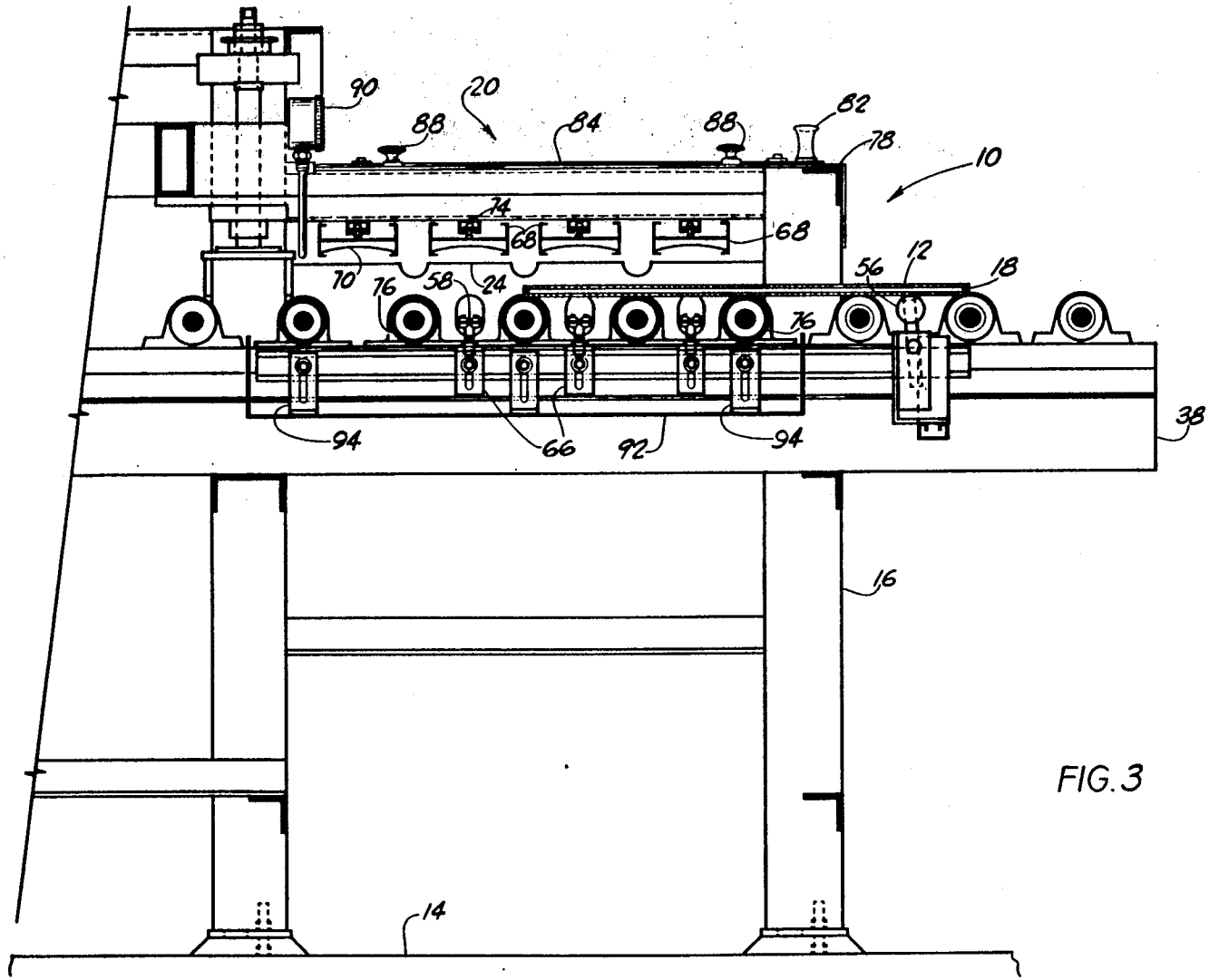
FIG. 3 is a longitudinal cross-sectioned view of the oven unit taken along Lines III—III of FIG. 2 showing the oven unit in its three-bulb configuration.
Figure 4:
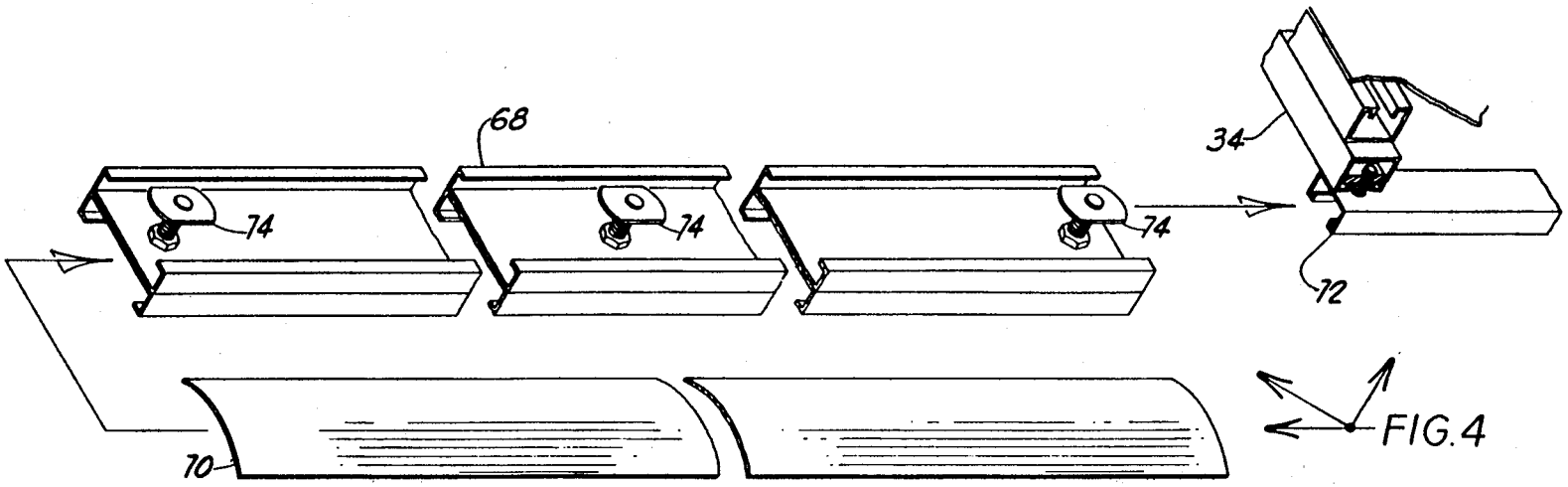
FIG. 4 is an enlarged fragmentary view from a downward perspective illustrating structural components of the oven unit first shown in FIG. 1.
Figure 5:
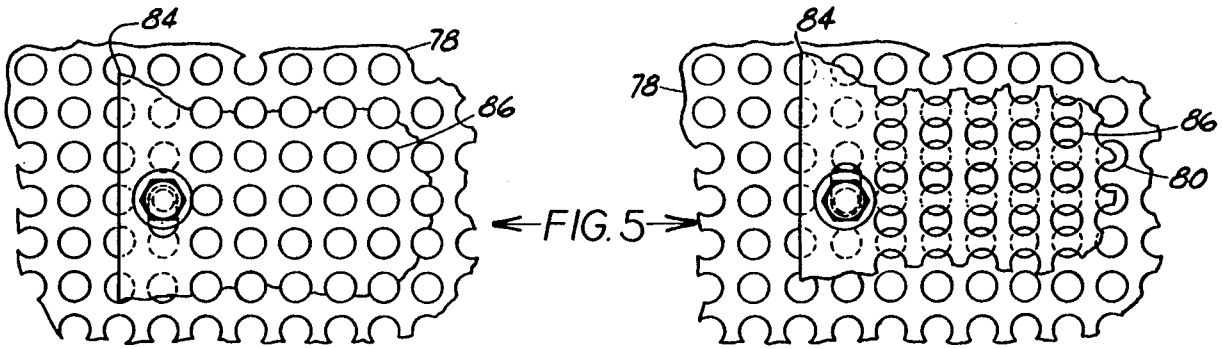
FIG. 5 is an enlarged fragmentary view of structural components of the oven unit first shown in FIG. 1.
Figure 6:
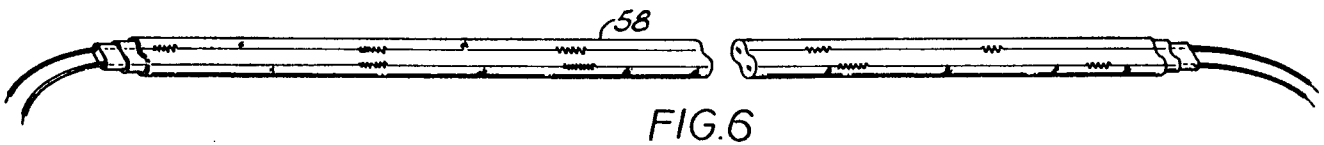
FIG. 6 is an enlarged perspective view of one of the radiant heat generating emitters first shown in FIG. 1.

As illustrated in FIGS. 1-3, the frame members 16 have a lower end which is secured to the floor surface 14 and an upper portion for supporting the oven box 20. More specifically, the upper portion of each frame member 16 supports each sidewall 22, housing 28, and cover 30. Each sidewall 22 includes, at its upper portion, an elongated support member 34 which is supported by and mounted to each respective sidewall 22. Each support member 34 is spaced from the top of each sidewall 22, creating an elongated open slot, is generally coequal in length with each respective sidewall 22, and may be an elongated unistrut member whose purpose will be described hereinafter.

The unit 10 of FIGS. 1-3 and 7 utilizes a conveyance means for conveying the workpiece 12 in a horizontal and linear pathway through the oven box 20 from the entrance end to the exit end. The conveyance means includes a plurality of spaced-apart, cylindrical rollers that extend between each sidewall 22 and are located within the oven box 20. The rollers 36 are arranged in a line from the entrance end to the exit end of the oven box 20. In addition, projecting out of the oven box 20 at the entrance end thereof and serving as an external structure 38 for starting the workpiece 12 in its linear and horizontal path into the oven box 20 are several more rollers 36. The path of travel of the workpiece 12 is indicated by the directional arrow. The rollers 36 are driven by a 0.5 hp, 1,750 rpm motor 40 for driving a sprocket and gear assembly. FIG. 2 shows a gear box 42, a drive sprocket 44, a pulley sprocket 46, and the motor 40. The motor assembly also includes a number of other pulley sprockets and also a roller chain 48 riding upon the drive sprocket 44 and the pulley sprockets. The oven box 20 includes a pair of spaced-apart transverse support beams 50 extending from one sidewall 22 to the other sidewall 22 transverse to the linear path of the workpiece 12 and adjacent the entrance and exit end, respectively; one beam 50 is shown in FIG. 2. Mounted to each beam 50 and extending the length of the oven box 20 adjacent to each sidewall 22 is a longitudinal support beam 52, and mounted to each beam 52

(which may be a unistrut member) and extending generally coequal in length is a unistrut structure 54 upon which the rollers 36 and other structural elements to be described hereinafter are mounted.

As shown in FIGS. 1 and 3, a limit switch 56 is utilized for determining when the leading edge of the workpiece 12 enters the oven box 20 through the entrance end and when the trailing edge enters the oven box 20 through the entrance end. In the oven box 20, the limit switch 56 can be placed at the entrance end whereby the leading edge of the workpiece 12 actuates the switch 56, turning on the heat generating means for heat treating the workpiece 12, then the trailing edge of the workpiece 12 deactivates the switch 56, shutting off the heat generating means. An alternative is to have one limit switch positioned at the entrance end for actuation when the leading edge of the workpiece 12 passes over the limit switch, thus turning on the heat generating means, and positioning another limit switch at the exit end for shutting off the heat generating means after the trailing edge of the workpiece 12 has passed over and actuated that particular limit switch. In the unit 10, one limit switch 56 is shown positioned external to the oven box 20 before the entrance end, generally centrally located and supported on a crosspiece of the guideway 38. The workpiece 12 physically contacts and thereby activates the limit switch 56 of the present invention.

Figure 7:
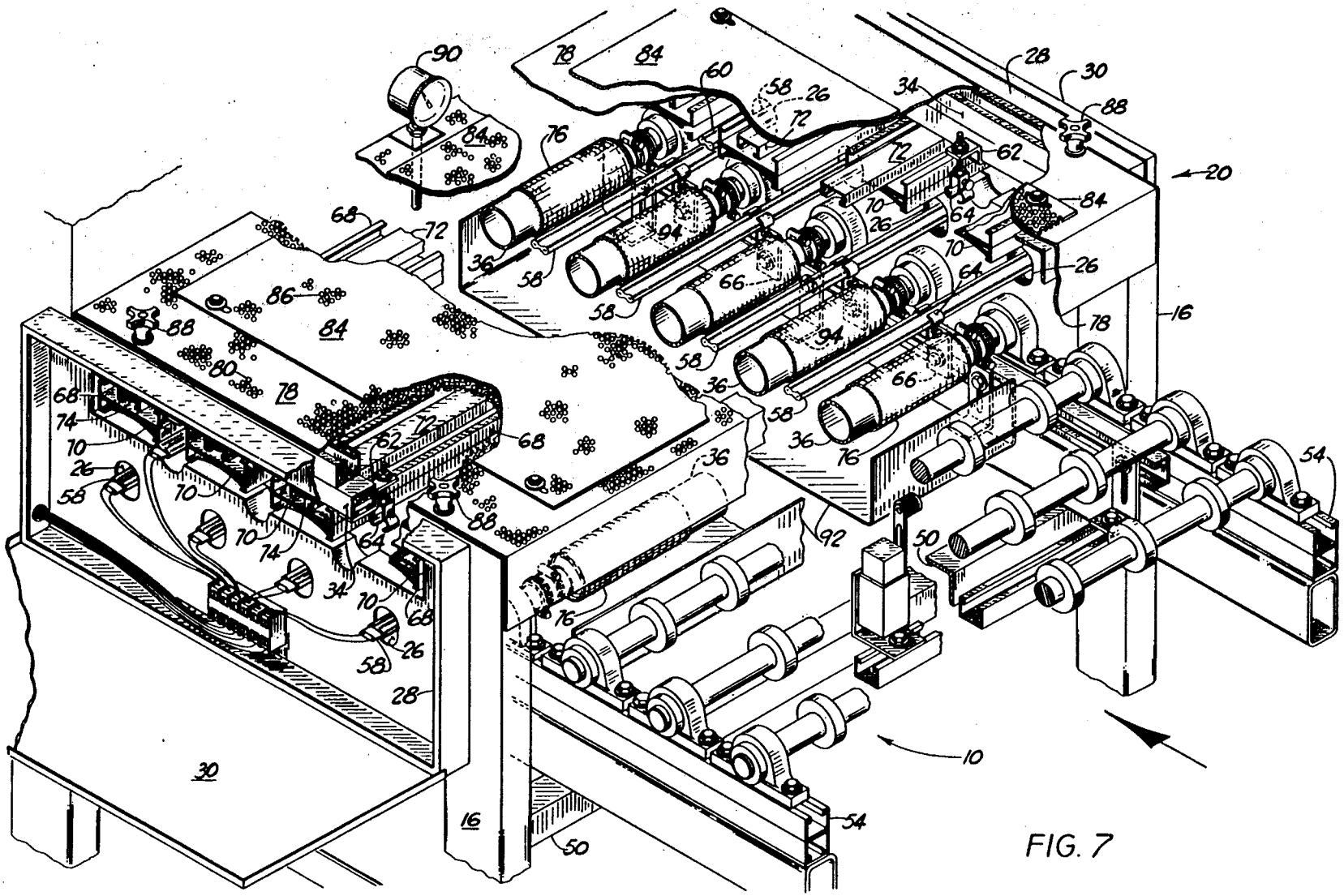
FIG. 7 is an isometric view of the oven unit first shown in FIG. 1 broken away at several places to reveal structural components of the oven unit.

FIGS. 1-3, 6, and 7 illustrate the radiant heat energy generating means utilized by the unit 10. The sealant material must be subjected to a heating process or treatment to achieve an airtight hermetic seal between the panes of glass of the window unit and the sealant material. The hermetic seal must prevent moisture from entering the interior region between the panes of glass and must also firmly secure the sealant material to each pane on the window unit so that the panes are in secure, spaced, parallel relationship. In addition, the heating process is adapted to distribute heat into the metal spacers to facilitate conductive heat flow therethrough for enhancing the bonding of the sealant material to the perimeter edges of the workpiece 12. The unit 10 utilizes a plurality of removably insertable, elongated, radiant heat generating emitters for heat treating the sealant strip material. The emitters are disposed within the oven box 20 and extend transverse to the rollers 36 and the linear horizontal path of the workpiece 12 and, as illustrated in FIGS. 2 and 7, the terminal end of each emitter protrudes through each respective sidewall. More specifically, the unit 10 includes a lower row of emitters 58 interspersed among the rollers 36, as shown in FIGS. 1—3, and 7, and an upper row of spaced-apart emitters 60 located immediately adjacent and above the line of travel of the workpiece 12. The unit 10 of FIG. 1 comprises a six-bulb configuration wherein four emitters 58 are alternately placed between the rollers 36 subjacent to the linearly conveyed workpiece 12 and two emitters 60 are placed immediately adjacent and above the workpiece 12. In addition, the emitters 58 and 60 are staggered to achieve maximum dispersal of radiant heat upon the workpiece 12.

FIG. 2 is a view of the oven box 20 from the entrance end thereof and shows one of the emitters 60 of the upper row and one of the emitters 58 of the lower row, both extending transverse to the line of travel of the workpiece 12 from one sidewall 22 to the other sidewall 22. The terminal contact ends of the emitter 58 protrude through each respective hole 26 and the terminal contacts of the emitter 60 protrude above the tops of the sidewalls 22 and the block 24. The terminal contact ends of the emitters 58 and 60 are shielded by each cover 30.

Both the upper row of emitters 60 and the lower row of emitters 58 are selectively vertically adjustable to or away from the workpiece 12 and the pass line in order to accommodate window units having various thicknesses and also for directing a maximum amount of radiant heat energy upon the sealant material. The emitters 60 are secured to each respective support member 34 adjacent their terminal ends by means of a lamp clip 62 and a clamp 64. The clamps 64 come in two varieties: a spring-mounting type and a clamp-mounting type. As shown in FIGS. 1-3 and 7, the spring-mounting clamp 64 is utilized in the unit 10. FIG. 2 illustrates one pair of S-shaped clips 62 utilized for mounting the emitters 60. Each clip 62 shown in FIG. 2 is mounted to each respective support member 34 with a portion thereof projecting horizontally into the oven box 20 above the rollers 36. One spring-mounting clamp 64 is secured to the horizontally projecting portion of each clip 62 and projects vertically and downwardly toward the roller 36 and the workpiece 12. FIG. 1 is a cross-sectioned elevational view of the six-bulb oven unit configuration showing two clips 62 with their respective downwardly-projecting spring-mounting clamps 64 mounted thereto for securely maintaining therein one emitter 60.

As shown in FIG. 2, it requires only two clips 62 and two clamps 64 for suspending each emitter 60 from one sidewall 22 to the other sidewall 22. By loosening the adjustable nuts from the post or stem portion of each clamp 64, the clamp 64 can be vertically adjusted within the clip 62 to lower or raise the emitter 60. FIG. 3 illustrates a three-bulb configured oven unit wherein only the emitters 58 are spaced between the rollers 36. In the six-bulb configured unit 10, as shown in FIG. 1, each emitter 60 is simply slidably inserted into the downwardly-projecting clamp 64 attached to one clip 62 and then the emitter 60 is directed transversely across the oven box 20. As shown in FIG. 2, the terminal contact end of the the emitter 60 is slidably inserted through the oppositely-disposed clamp 64. The operator must first swing the cover 30, at the side where he is standing, down in order to access the elongated slot so as to slidably insert the emitter 60 into place. The emitters 60 can also be horizontally adjusted between the entrance end and the exit end of the oven box 20 by loosening and displacing the two respective clips 62 associated with each of the emitters 60, moving each respective clip 62 downstream or upstream and then remounting the clips 62 to their respective support members 34. The vertical adjustment of the emitters 58 to or away from the workpiece 12 and the pass line is accomplished in a different manner.

As shown in FIGS. 1-3 and 7, the emitters 58 are mounted to the clamps 64 and their terminal contact ends slightly protrude out of each respective and opposed hole 26. The clamps 64 project upwardly toward the workpiece 12 and are spaced between each roller 36. Each clamp 64 is mounted to an adjustable clip 66 having a slotted horizontal portion and a slotted vertical portion with each clip 66 being attached or mounted by bolting to the respective elongated unistrut structure 54. Each clip 66 can be vertically adjusted by simply loosening the hex bolt and slidably moving each clip 66 upward or downward until it is appropriately positioned and then the bolt is tightened, thus securing the adjustable clip 66 in place to the unistrut structure 54.

FIG. 1 shows the vertical slotted portion of each clip 66 which limits the vertical adjustability of each clip 66 by the length of the vertical slotted portion thereof.

For the upper row of emitters 60, at least two inches clearance is required to accommodate window units of various thicknesses, and for the lower row of emitters 58, the optimum distance the emitters 58 are placed to the undersurface of the workpiece 12 is one-half inch. The emitters 58 are inserted into each respective clamp 64 in the same manner generally as emitters 60. The operator opens one cover 30 exposing the sidewall 22, the sidewall apertures, and the holes 26. The operator slidably inserts one terminal contact end of the emitter 58 through the respective sidewall aperture and hole 26 and through the adjacent clamp 64. The operator continues to slidably push the emitter 58 through the oven box 20 transverse to the linear pathway of the workpiece 12 to the opposite side wherein the terminal contact end is aligned with and slidably inserted through the oppositely-mounted clamp 64 and then pushed through so that the terminal contact end projects through the respective hole 26 and aperture of the opposite sidewall 22. Because of the construction of the emitters 58 and 60, center hangers are generally not needed in order to support the emitters 60.

FIG. 2 shows the unit 10 looking into the oven box 20 from the entrance end thereof. The emitters 58 and 60 can vary in length from 60 inches to 72 inches to 84 inches and the heated length of the particular emitter utilized is always one inch longer than the specified width of the oven box 20. This is done so that all perimeter edges of the sealant strip material applied to the workpiece 12 are subjected to the heat treating process. For example, an oven box having a width of 60 inches would run nothing wider than a 60-inch window unit and the heated length of the emitter would be 61 inches so the perimeter edges of the workpiece, adjacent each respective sidewall as the workpiece is horizontally and linearly conveyed through the oven box, receives heat treating. The unit 10 is a modular structure for accommodating a six-bulb structure as shown in FIG. 1, or a three-bulb structure as shown in FIG. 3. For the six-bulb structure, there are four emitters 58 alternately interspersed among the rollers 36 and two emitters 60. In the three-bulb configuration as shown in FIG. 3, three emitters 58 are disposed in the lower row and are alternately interspersed among the rollers 36. There is no upper row of emitters in the three-bulb configuration. Because the unit 10 is of a modular structure it can easily be converted from a three-bulb system to a six-bulb system or vice versa. Because the emitters 58 and 60 are slidably mounted onto the clamps 64, to go from a six-bulb configuration to a three-bulb configuration, the operator would simply open one cover 30, thus exposing the holes 26 and the terminal contact ends of the emitters 58 and 60. The operator would then disconnect the electrical lead wires that project from the terminal contact ends and which hook into an electrical structure located at the bottom of the cover 30 as shown in FIGS. 2 and 7. With the wire leads disconnected, the operator can then simply grasp the projecting terminal contact end and start slidably pulling the emitter 60 toward him until it is free from both respective clamps 64 and fully removed from the unit 10. The operator would then follow the same procedure in removing the other emitter 60. In addition, the operator would remove in the same fashion the emitter 58 adjacent to the exit end of the oven box. Thus, the six-bulb configured unit 10 would be easily converted to a three-bulb configured unit 10 if so desired.

The emitters 58 and 60 are of the twin tube quartz-type with a built-in gold reflecting shield to enhance the energy output of the heating coil. The terminal contact or wire ends are designed so as to extend outside the heating zone of the oven box 20 to increase the longevity of the emitters 58 and 60.

The emitters 58 and 60 of the present invention are utilized for their fast response time: the entire emitters light within three seconds and have a three second response time to cool down. The emitters reach their maximum temperature of approximately 1,600° C. in 2.5 seconds. At this approximate temperature the emitters produce infrared radiation in the short (near) band of the infrared spectrum, the wavelength being approximately 1.6 microns. Thus, the emitters of the present invention have a high watt density output of 90 $kw/m^2$; less power is needed to bring the emitters to their maximum temperature but they are more efficient in the use of energy in that more of the radiant heat reaches the sealant material. In addition, the twin tube quartz emitters utilized in the present invention are ruggedly constructed and extremely durable, and their continuous running times or periods are much longer than many other types of emitters.

In order to refocus and redirect radiant heat energy generated by the emitters 58 and 60 onto the workpiece 12 for achieving maximum heat treating, a plurality of reflector housings 68, with each reflector housing 68 having mounted therein a heat reflective panel 70, are utilized by the unit 10 of the present invention. As shown in FIGS. 1–4, and 7, the unit 10 includes a plurality of removably insertable, spaced-apart reflector housings 68 alternately interspersed among the emitters 60 and extending between the sidewalls 22 transverse to and above the linear path of the workpiece 12. Extending across the width of the oven box 20, transverse to and above the linear path of the workpiece 12 and the line of the rollers 36, are a plurality of spaced-apart reflector guides 72 with each guide 72 being attached to the respective support member 34. The guides 72 are spaced from each other, as shown in FIGS. 1, 3, and 7, and slidably mounted on each guide 72 is one housing 68. Each housing 68 includes two spaced-apart vertical side members attached to each other by a horizontally-extending member disposed therebetween. Each opposed depending vertical side member includes an inwardly-projecting lower lip and an inwardly-projecting upper lip, with the projection of each pair of lips being horizontal, parallel, and inward to each other. The housings 68 are spaced above the workpiece 12 and the rollers 36 and extend adjacent to each sidewall 22. Each housing 68 has three upwardly-projecting T-shaped members 74 mounted to the horizontally-extending member. The members 74 are spaced from each other with one member 74 centrally mounted on each guide 72 and the other members 74 mounted at either end of each guide 72. The members 74 are slidably received within the guides 72 for slidable insertion and removal therefrom. In order to remove the housing 68 for repair or maintenance, the operator would simply swing open one cover 30 downward toward him, reach in and grasp each opposed depending side member, and then pull the housing 68 toward him, sliding each member 74 within the guide 72 which serves as a rail or track, until the entire housing 68 is removed from that respective guide 72.

As illustrated in FIGS. 1-4, each housing 68 has mounted therein the panel 70 for refocusing and redirecting radiant heat energy generated by the emitters 58 and 60 onto the sealant strip material as the workpiece 12 is being conveyed through the oven box 20. Each housing 68 includes the panel 70 slidably mounted therein; in the six-bulb configured unit 10 shown in FIG. 1, four housings 68 are shown with each housing 68 having mounted therein a panel 70. The panels 70 are adapted for reflecting and dispersing radiant heat energy onto the sealant material for facilitating heat treatment of the material. The panels 70 are preferably manufactured from 28-gauge aluminum clad steel having a highly polished inner, concave surface for reflecting and dispersing the radiant heat; the housings 68 are preferably manufactured from 16 gauge aluminum clad steel. When each panel 70 is mounted within each respective housing 68, they display a concave or cambered shape by being snapped and slightly bent to fit within each respective housing 68 and are generally coequal in length with the housings 68. The panels 70 generally rest in the crook between each inwardly-projecting lower lip and each depending side member.

In order to insert each panel 70 within each housing 68 after the housing 68 has been slidably mounted to the respective guide 72, and with the cover 30 open, the operator simply grasps one panel 70 and inserts it into the housing 68 where each long edge of the panel 70 rests upon the crook created by the integral attachment of each inwardly-projecting lower lip to each opposed vertical side member. The operator slides the panel 70 all the way into the housing 68 so that it is contained within the housing 68 and does not protrude out from one side. To remove a panel 70 for inspection or replacement as the panels 70 lose their flexibility over time, the operator would simply open one cover 30, reach in and grasp the panel 70 he desired to remove, and slidably pull it toward him until it was completely removed from that respective housing 68. The cambered shape the panels 70 attain when they are loaded into the housings 68 helps to hold them within their respective housing 68.

There is shown in FIGS. 1 and 2 a plurality of smooth reflective insulative members 76 disposed for removable insertion and covering onto each respective roller 36. The members 76 are insulation-type socks manufactured preferably from fiberglass and snugly inserted over each respective roller 36 for providing a smooth surface upon which the workpiece 12 can travel. The fiberglass is a light, silverish, woven mesh material 1/16-inch thick that can be tightly and snugly pulled over one end of the roller 36 and then clamped at the other end of the roller 36 by using a common hose clamp. Each member 76 provides an insulative barrier between the rollers 36 and the window units being successively conveyed through the oven box 20. In most applications the unit 10 will receive hundreds and perhaps thousands of windows per day as part of the manufacturing process. Therefore, the continuous friction of the window units against the rollers 36 as the window units are being linearly conveyed therethrough will cause the rollers 36 to heat up; to reduce this friction the members 76 are utilized. The window units can ride on the member 76 instead of the hard surface of the rollers 36. In addition, the members 76 have a reflective surface which helps to redirect radiant heat energy generated by the emitters 58 and 60 onto the sealant material.

FIGS. 1, 2, 5, and 7 illustrates a venting means utilized by the unit 10 to regulate the thermal temperature within the oven box 20 resulting from the heat generated by the emitters 58 and 60 and to allow for heat dissipation or dispersal from the oven box 20. It is well known in the art that the radiant heat energy generated by the various types of emitters affects the integrity of the glass panes of the window unit. The venting means of the present invention includes a damper system disposed on the top of the unit 10 and covering the oven box 20. Essentially the venting means is two sheets disposed one on top of the other, one of which can slidably move in a horizontal manner and the other lower sheet which is generally maintained in the stationary position. More specifically, the damper system includes a lower flat sheet member 78 having a plurality of damper holes 80 equidistantly spaced and generally covering a substantial portion of the lower member 78. The lower member 78 is positioned atop and covers the oven box 20, and is adapted for permitting radiant heat to escape through the damper holes 80. The lower member 78 is secured to the top of the oven box 20 by at least four threaded bolts or screws, each one integrally affixed to a manually turnable, vertically-projecting insulated knob 82. One knob 82 and screw assembly is located at each corner of the lower member 78 so that two knobs 82 and screw assemblies are fastened to one support member 34 and the other two knobs 82 and screw assemblies fasten to the other support member 34. A flat upper member 84 is positioned atop and also covering the oven box 20 and includes a plurality of vent holes 86 equidistantly spaced on the upper member 84 and substantially covering the surface area of the upper member 84. The upper member 84, which is smaller than the lower member 78, is slidably disposed superjacent to the lower member 78 for selectively covering or uncovering the damper holes 80 of the lower member 78 by aligning or misaligning the vent holes 86 with the damper holes 80. At each corner of the upper member 84 a spring plunger 88, or a rod, pin, or threaded screw, is mounted for projecting through the appropriately aligned vent holes 86 and damper holes 80. The plungers 88 maintain the horizontal placement of the upper member 84 contiguous to the lower member 78. In one position the vent holes 86 and the damper holes 80 are both aligned to each other; the upper member 84 is then manually and horizontally slid upon the lower member 78 to substantially close the damper holes 80 by misaligning the vent holes 86.

Provision is made, as illustrated in FIGS. 1, 2, 3, and 7, for both the lower member 78 and the upper member 84 to have an incised rectangular cut centrally located and along the edge adjacent the exit end of the oven box 20 wherein a thermal heating probe 90 or temperature gauge can be inserted and which projects down into the oven box 20. It should be noted that the upper member 84 is horizontally moved in the same direction as the pass line of the workpiece 12 through the oven box 20 by the operator standing at the entrance end and appropriately releasing the plunger 88, shifting the upper member 84 to cover a substantial number of damper holes 80, and then releasing the plunger 88 to maintain the upper member 84 in its new position. The probe 90 is visually monitored by the operator in order to regulate and control the internal temperature of the oven box 20. Also, the automatic regulation and control of the atmosphere within the oven box 20 can be done by computer-controlled sensors: one package may be an scr-type system.

As shown in FIGS. 1-3 and 7, there is disposed beneath the rollers 36 and the emitters 58 a lower reflector pan 92. The lower reflector pan 92 is the same width as the major portion of the rollers 36 and extends generally from the entrance end to the exit end of the oven box 20. The pan 92 rests upon a plurality of adjustable clips 94, one pair of which is shown in FIG. 2. These downwardly- and inwardly-projecting adjustable clips 94 are mounted to, and the same as, the adjustable clips 66 to which the clamps 64 holding the emitters 58 are mounted. Clips 94 are aligned with clips 66 so that their vertical slotted portions are aligned, and then both clips 66 and 94 are bolted to the unistrut structure 54. The pan 92 is utilized as a secondary radiant heat reflective surface for reflecting and directing radiant heat energy onto the sealant strip material. The pan 94 is not as efficient as the panels 70 mounted within the housings 68. They do, however, reflect a certain percentage of radiant heat back onto the sealant strip material. In addition, the pan 94 could act as a baffle in order to prevent cold air drafts from coming up through the oven box 20 which would cause convective heat loss within the oven box 20. The pan 94 could also possibly be replaced by the damper system disposed on top and covering the oven box 20 so as to achieve a controlled and regulated venting of the bottom of the oven box 20.

Figure 8:
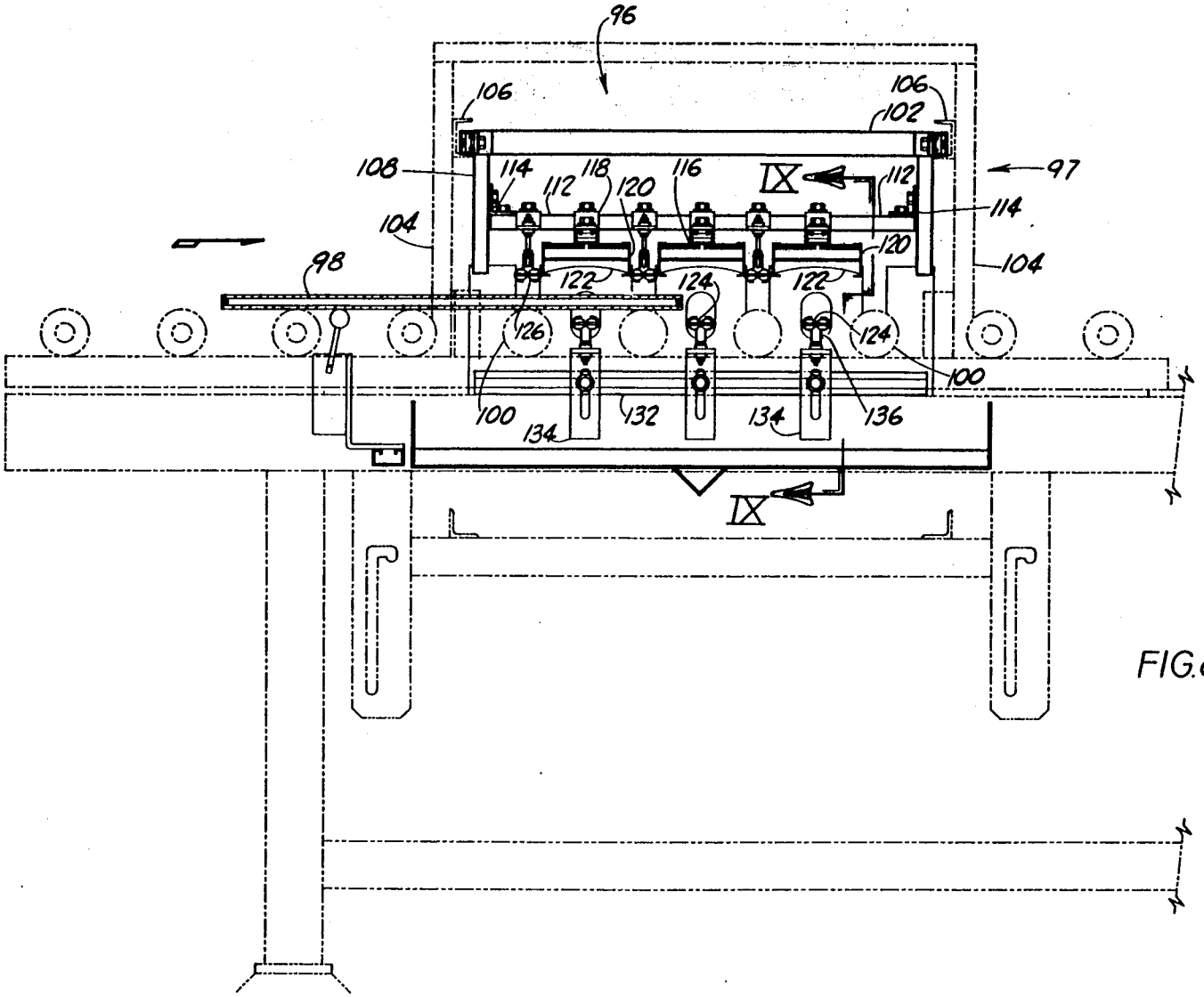
FIG. 8 is a cross-sectioned longitudinal view of a retrofitted oven unit taken along Lines IX—IX of FIG. 9.
Figure 9:
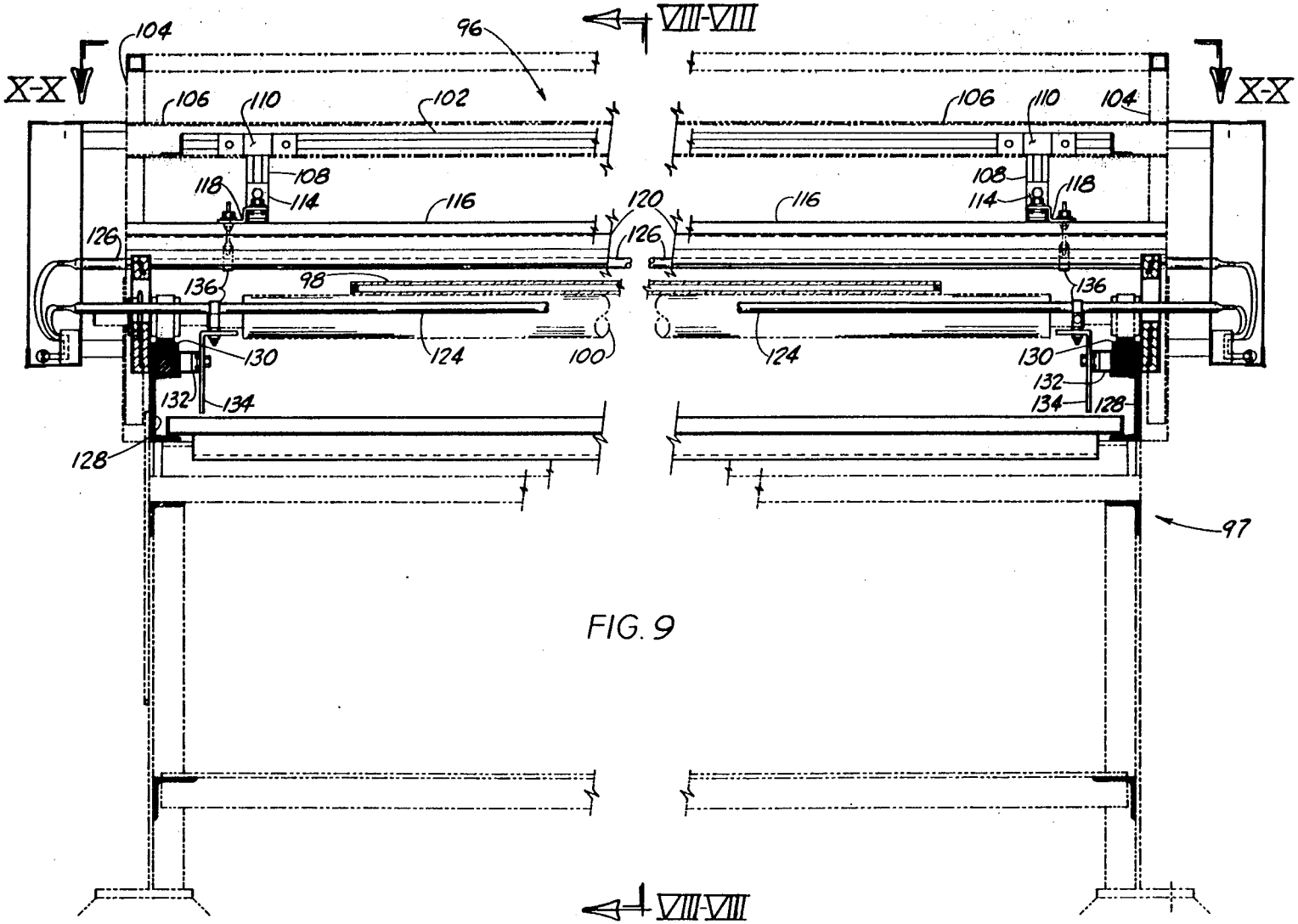
FIG. 9 is a cross-sectioned view of the retrofitted oven unit from the entrance end taken along Lines VIII—VIII of FIG. 8.
Figure 10:
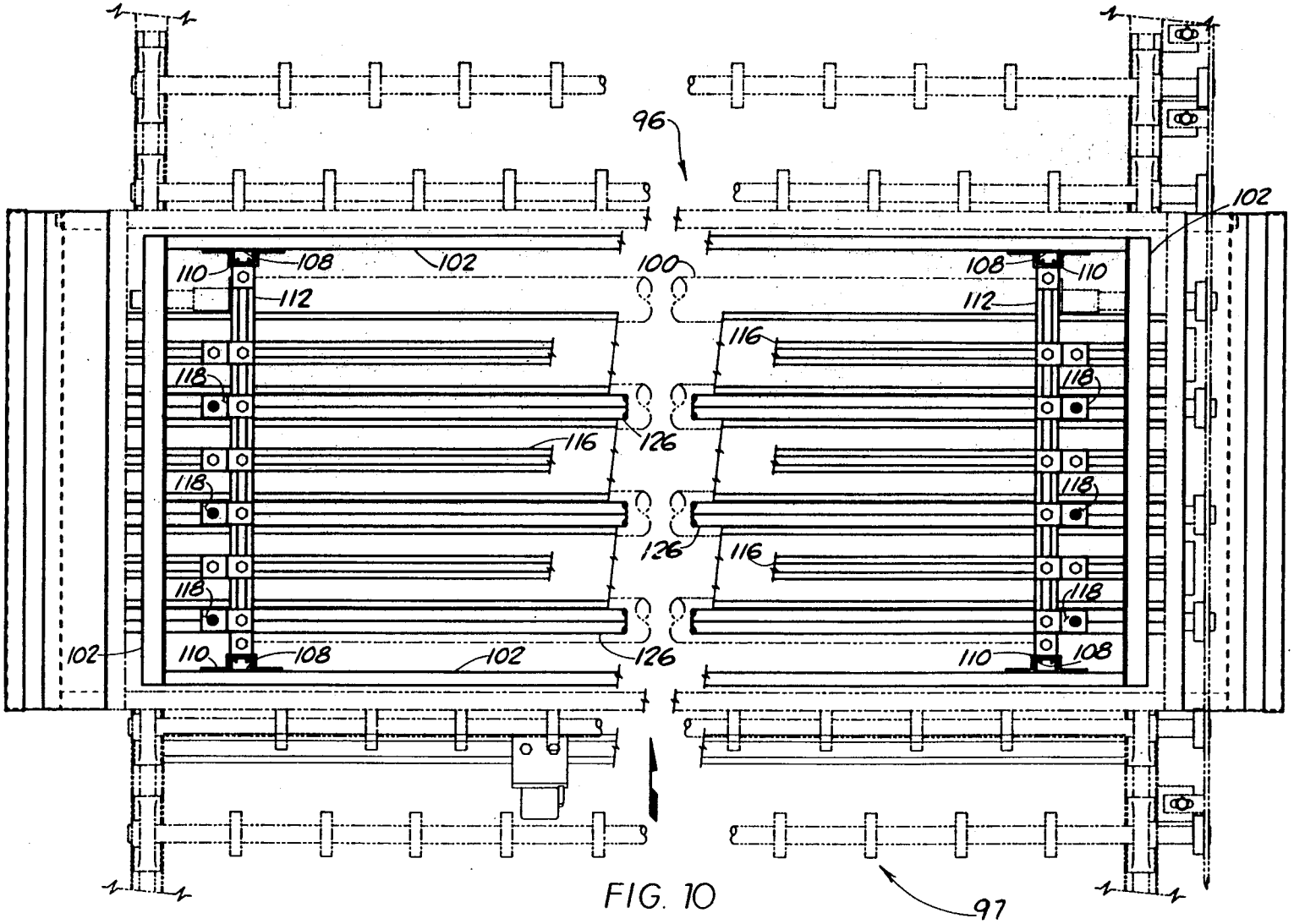
FIG. 10 is a top plan view of the oven unit taken along Lines X—X of FIG. 9.

FIGS. 8-10 illustrate an oven unit 96 adapted for retrofit placement within an existing oven structure 97 for heat treating and curing sealant strip material applied to the perimeter edges of a workpiece 98, such as a door or window unit, which is linearly and horizontally conveyed from the entrance end to the exit end of the unit 96 by a plurality of spaced-apart, linearly arranged rollers 100. The retrofitted unit 96 includes a rectangular-shaped frame rail 102 which is adapted for slidable placement within the existing oven structure 97 above the rollers 100. The oven structure 97 includes at least four vertically upright support frame members 104 with each member 104 located at the corner of the oven structure 97. Two of the frame members 104 would be located at the entrance end of the oven structure 97 and spaced from each other, and two of the frame members 104 would be located at the exit end of the oven structure 97 and spaced apart from each other. Extending between and attached to the frame members 104 located at both the entrance end and the exit end is an elongated channel member 106.

The rail 102 is adapted for slidable placement within the existing oven structure 97 above the rollers 100, and more specifically, the rail 102 is slidably disposed within each respective channel member 106 as shown in FIGS. 8 and 9. Mounted to and downwardly projecting from each corner of the rail 102 is a post 108. The unit 96 utilizes four downwardly-projecting posts 108 mounted to the rail 102 by strap members 110, as shown in FIGS. 8-10, with each post 108 terminating at a point above the line of the rollers 100 and the pass line of the workpiece 98.

As shown in FIGS. 8 and 10, a pair of bridge members 112 are attached to the posts 108. Each elongated bridge member 112 is attached to one post 108 located at the entrance end of the unit 96 by a right-angle clip 114 and extends longitudinally along and above the line of the rollers 100 to the aligned post 108 downwardly projecting from the rail 102 at the exit end of the unit 96. That end of the bridge member 112 is also attached to the respective post 108 by one clip 114 as shown most clearly in FIG. 8. Oppositely disposed from this bridge member 112 is the other bridge member 112 which is attached to the opposite post 108, located at the entrance end of the unit 96, by one clip 114 and which extends longitudinally along the line of the rollers 100 to the other aligned post 108 downwardly projecting from the rail 102 at the other corner adjacent the exit end of the unit 96. Thus, both bridge members 112 extend from the entrance end to the exit end of the unit 96 adjacent and above the ends of each roller 100 and are parallel to one another.

The unit 96 includes a plurality of spaced-apart, elongated reflector guides 116 suspended from and attached to each bridge member 112. Each guide 116 extends above and transverse to the line of the rollers 100 and the pass line of the workpiece 98. The guides 116 are in spaced parallel relationship to one another as shown in FIG. 8. S-shaped lamp clips 118 are used to mount the guides 116 to the bridge members 112. FIG. 10 best illustrates the manner in which the clips 118 mount the guides 116 to each bridge member 112 wherein one clip 118 is secured to one bridge member 112 and another clip 118 is secured to the other bridge member 112 and both clips 118 are directly aligned to each other. The guide 116 is then mounted to each clip 118 at both ends of the respective guide 116.

Adapted for slidable insertion and removal onto each respective guide 116 is a reflector housing 120. In the unit 96 three guides 116 and three housings 120 are shown. The guides 116 may be of a slightly different configuration than the guides 72 of the preferred embodiment. Each guide 116, like each guide 72 in the preferred embodiment, serves as a rail or track upon which the housings 120 can be slidably inserted and removed if repair, maintenance, or replacement is needed. The housings 120 extend transverse to the line of the rollers 100 and the pass line of the workpiece 98 and when disposed in their operative position each inwardly-projecting lower horizontal lip should be positioned two inches from the pass line. Each housing 120 is slidably inserted on each respective guide 116 by aligning each opposed upper horizontally projecting lip of each housing 120 with the flat projecting edges of each guide 116 and then sliding the housing 120 on the guide 116, using the horizontally projecting edges as a rail or track. As shown in FIGS. 8 and 9, the guides 116 with the housings 120 slidably mounted thereon extend from one bridge member 112 to the other bridge member 112 spanning the width of the unit 96.

FIG. 8 illustrates a plurality of removably insertable heat reflective panels 122 with one panel 122 mounted within each respective housing 120. The panels 122 are manufactured out of the same material as the panels 70 of the preferred embodiment: flexible, 28-gauge aluminum-clad steel with a highly polished interior concave surface. The panels 122 are adapted to reflect and redirect radiant heat energy upon the sealant strip material for facilitating the heat treatment and curing thereof. The panels 122, three of which are shown in FIG. 7, have a cambered or concave shape due to their fitting within each respective housing 120. When each panel 122 is slidably disposed within each respective housing 120, the long edges of the panel 122 are contiguously pressed into the jointure of each opposed inwardly-projecting horizontal lower lip and vertical side member of the housing 120. This manner of mounting one panel 122 to one housing 120 maintains the cambered shape of the reflective panels.

As shown in FIGS. 8-9 a plurality of removably insertable radiant heat generating emitters are alternately interspersed among the rollers 100 and the housings 120 for generating and directing radiant heat energy upon the sealant strip material applied to the perimeter edges of the workpiece 98. The emitters shown in FIG. 8 are part of a six-bulb configuration oven unit wherein three emitters 124, comprising the lower row of emitters, are interspersed among the rollers 100 and extend between the oven structure 97 and three emitters 126, comprising the upper row of emitters, are placed above the pass line of the workpiece 98 and the rollers 100. The lower emitters 124 and the upper emitters 126 extend transverse to the linear path of the workpiece 98 with the lower emitters 124 being spaced an optimum distance of one-half inch from the undersurface of the workpiece 98 to achieve maximum radiant heat generating effect, and the upper emitters 126 are spaced at least two inches from the pass line of the workpiece 98. The emitters 124 and 126 are of the same type as described in the preferred embodiment of the present invention.

As shown in FIG. 8 the emitters 124 interspersed among the rollers 100 and extending transverse to the path of the workpiece 98 are adapted for vertically adjustable movement to or away from the workpiece 98 to achieve maximum generation of radiant heat upon the sealant material. Mounted to each opposed sidewall of the oven structure 97 is a horizontal and longitudinally-extending lower channel 128 as shown in FIG. 9. Superjacent and contiguous to each channel 128 is a longitudinally-extending bearing block 130. Each block 130 extends substantially the same length as each respective channel 128. The retrofitted oven unit 96 includes a pair of elongated lamp mounts 132 with each mount 132 being bolted and secured to each respective block 130, and each mount 132 extends substantially the same length longitudinally along and adjacent each sidewall as each respective channel 128 and block 130. The channels 128, the blocks 130, and the mounts 132 are positioned adjacent each respective sidewall of the oven structure 97 subjacent the ends of the rollers 100.

Referring to FIGS. 8 and 9, mounted to each respective mount 132 and linearly spaced therealong are a plurality of adjustable right-angled clips 134 having a horizontally slotted portion and a vertically slotted portion. The clips 134 are arranged so that one clip 134 mounted to one mount 132 is directly aligned with one clip 134 mounted to the opposite mount 132. Since the unit 96 is a six-bulb configuration with three upper emitters 126 and three lower emitters 124, there will be a total of six clips 134 used, three clips 134 equally spaced apart and mounted to one mount 132 and three clips 134 spaced equally apart and mounted to the other mount 132. The clips 134 on one mount 132 will be directly across from and aligned with the three clips 134 on the opposed mount 132. Mounted to each clip 134 is a clamp 136, of either the spring-mounting or clamp-mounting variety as was described in the preferred embodiment. Each clamp 136 extends upward toward the pass line and the linear path of the workpiece 98 being conveyed through the unit 96. It should also be noted that the clips 134 are interspersed among the rollers 100 so that an alternating sequence of one roller 100 and then one adjustable clip 134 with a clamp 136 mounted to it and then another roller 100 followed by another adjustable clip 134 and clamp 136 mounted thereto, etc.

In the unit 96 shown in FIGS. 9 and 10, a total of three upper emitters 126 are interspersed among the housings 120 and extend transverse to each sidewall. The upper emitters 126 are located immediately above the linearly conveyed workpiece 98 and are disposed to allow at least two inches clearance from the top surface of the workpiece 98 due to the varying widths of window and door units being conveyed through the oven structure 97. The upper emitters 126 are adapted for directing radiant heat energy onto the sealant strip material for heat treating as the sealant material passes through the oven unit 96 when disposed along the perimeter edges of the workpiece 98.

The upper emitters 126 are disposed in their operative position in the following manner. Attached to the bridge members 112 and equally spaced along the length of each bridge member 112 are the clips 118. As shown in FIG. 10, three clips 118 are mounted to one bridge member 112 and equally spaced from one another, and three clips 118 are mounted to the other bridge member 112, also equally spaced from each other. In addition, the clips 118 attached to one bridge member 112 are aligned with their respective opposite clips 118 attached to the other bridge member 112. The clips 118 are alternately interspersed among the guides 116 so that there is one clip 118, for example, attached to one bridge member 112 and one guide 116, then a clip 118 for mounting an emitter 126, then a clip 118 for mounting the next guide 116, etc. Mounted to each clip 118 is a clamp 136 of either the spring-mounting or clamp-mounting variety. The clamps 136 project downwardly toward the pass line and the linear path of travel of the workpiece 98, and each clamp 136 is disposed so as to be adjacent to the housings 120. The bottom of each clamp 136 should be generally level and adjacent with the lower horizontal projecting lips of each housing 120 although in FIG. 8 the clamps 136 are shown as projecting slightly down past the housings 120. The upper emitters 126 can then be slidably inserted through the clamps 136 by slidably inserting one terminal contact end of one upper emitter 126 through one clamp 136 mounted by one clip 134 to one bridge member 112, for example, and then pushing and sliding the emitter 126 across the oven structure 97 toward the opposed sidewall where it is slidably inserted through the opposed clamp 136 mounted to the clip 134 which is, in turn, secured to the opposite bridge member 112. In order to vary the distance the upper emitters 126 are disposed from the workpiece 98 traveling through the unit 96, the operator can unfasten the right-angled clips 114 that are used to mount the bridge members 112 to their respective posts 108 and then reposition the bridge members 112 along the vertically depending length of each respective post 108. The bridge members 112 can then be remounted to their respective posts 108 by using the right-angled clips 114. The bridge members 112 must be vertically adjusted in unison so both bridge members 112 are level and all of the upper emitters 126 are equally spaced from the workpiece 98 and generally level with one another and the lower projecting lips of the housings 120. The upper emitters 126 are also adapted for horizontally adjustable movement along the length of each bridge member 112 by simply unfastening the S-shaped clips 118 and adjusting them linearly along the length of each bridge member 112. In any horizontal adjustment, obviously, the repositioned clip 118 on one bridge member 112 must be aligned with the respective and oppositely-disposed clip 118 mounted to the other bridge member 112. In addition, the repositioning of each guide 116 and housing 120 must also be performed so as to insure proper placement of all the aforementioned structural components.

As shown in FIGS. 8 and 9, the lower emitters 124 are interspersed among the rollers 100 and extend between the sidewalls of the oven structure 97 transverse to the path of the workpiece 98 and subjacent thereto. The terminal contact ends of each lower emitter 124 project slightly through apertures in each respective sidewall of the oven structure 97 for permitting an operator to easily and quickly insert and remove each lower emitter 124 when necessary. Each lower emitter 124 is slidably inserted through each respective clamp 136 mounted to each respective clip 134 so that the operator positioned by one sidewall of the oven structure 97 can insert one terminal contact end of one emitter 124 through the clamp 136 and then slide the length of the emitter 124 through the clamp 136 across the width of the oven structure 97 to the oppositely-disposed clamp 136 so that the initial terminal contact end is now slightly projecting through the opposite sidewall of the oven structure 97. As was the case in the preferred embodiment, to achieve maximum heat treating of the sealant material, the lower emitters 124 should be placed at an optimum distance of one-half inch away from the lower surface of the workpiece 98.

In order to vertically adjust the lower emitters 124 so as to move the lower emitters 124 to or away from the workpiece 98, it is a simple matter to loosen each clip 134 from its securement to the respective mount 132 and slide the clips 134 up or down by the vertically slotted portion until the new desired position is achieved and then to resecure each clip 134 at the new position. The vertical adjustment of the clips 134 should be done in unison so that the horizontally slotted portion of all the clips 134 are level with each other, thus insuring that all of the lower emitters 124 are equally spaced from the undersurface of the workpiece being conveyed on the rollers 100 through the oven structure 97. It should be noted that the modularity and flexibility of adjustment of the oven unit 96 of the alternate embodiment is enhanced by the use of unistrut members which can be easily repositioned and rearranged with minimum effort by the workman. For example, the bridge members 112, the posts 108, the mounts 132, and the guides 116 are all unistrut members.

While the invention has been concerned with a particular preferred embodiment and a particular alternate embodiment, it is to be understood that many modifications and variations in the construction and arrangement thereof may be provided for without departing from the spirit and scope of the invention or sacrificing any of its advantages.

I claim:

1. An oven unit for heat-treating material applied to a workpiece, comprising:

an oven box having a pair of opposed, spaced-apart sidewalls and an upstream entrance end for receiving the workpiece and a downstream exit end for the egress of the workpiece after heat treating;

a conveyance means for conveying the workpiece through the oven box from the entrance end to the exit end;

a plurality of removably insertable radiant heat generating emitters disposed within the oven box, each emitter being elongated and transverse to the conveyance means for heating the material, with the end of each emitter protruding through each sidewall;

the emitters further characterized by a lower row of emitters interspersed among the conveyance means and located immediately adjacent and below the workpiece conveyed therethrough, and an upper row of spaced-apart emitters located immediately adjacent and above the workpiece;

a plurality of removably insertable, spaced-apart reflector housings interspersed among the upper row of emitters and extending between the sidewalls transverse to the path of the workpiece and parallel to one another, each reflector housing having opposed depending side members and an inwardly-projecting lip extending from each side member; and a plurality of removably insertable, elongated, heat-reflective panels with each panel mounted within each respective reflector housing, the panels adapted for reflecting and dispersing radiant heat onto the material for facilitating heat treatment of the material.

2. The oven unit of claim 1 wherein the conveyance means includes a plurality of spaced-apart rollers extending between each side wall for conveying the workpiece therealong in a linear path from the entrance end to the exit end of the oven box.

3. The oven unit of claim 2 further comprising a plurality of smooth reflective insulative members, each insulative member snugly inserted over each respective roller for providing a smooth surface upon which the workpiece can travel.

4. The oven unit of claim 3 wherein each insulative member insulates the respective roller from the radiant heat produced by the emitters and also reflects radiant heat onto the material.

5. The oven unit of claim 1, further comprising a venting means for dissipating radiant heat within the oven box.

6. The oven unit of claim 5 wherein the venting means includes a lower flat sheet member having a plurality of damper holes, the lower flat sheet member positioned atop and covering the oven box and adapted for permitting heat to escape through the damper holes.

7. The oven unit of claim 6 wherein the venting means includes a flat upper member positioned atop and covering the oven box and having a plurality of vent holes, the flat upper member slidably disposed superjacent the flat sheet member for selectively covering or uncovering the damper holes of the flat sheet member by aligning or misaligning the vent holes with the damper holes.

8. The oven unit of claim 1 wherein the reflective panels have a cambered shape for refocusing and redirecting radiant heat energy onto the sealant material when the panels are mounted within their respective housings.

9. The oven unit of claim 1 wherein the upper and lower rows of emitters are positioned at least one-half inch away from the workpiece when the workpiece is being conveyed through the oven box by the conveyance means.

10. The oven unit of claim 1 wherein the emitters generate infrared radiation in the short wavelength portion of the infrared spectrum at a wavelength of generally 1.6 microns.

11. The oven unit of claim 1 wherein the upper row of emitters and the lower row of emitters are selectively vertically adjustable to or away from the workpiece being conveyed therethrough for directing maximum radiant heat upon the material.

12. An oven unit for placement in an existing oven structure for treating material applied to a workpiece which is being conveyed therethrough from an entrance end to an exit end by a plurality of spaced-apart, successively aligned rollers, the oven unit comprising:

a rectangular-shaped frame rail adapted for slidable placement within the existing oven structure above the rollers;

four posts downwardly projecting from the corners of the frame rail and terminating above the line of the rollers;

a pair of spaced-apart, elongated bridge members, with each bridge member attached to a pair of posts and extending above and along the line of the rollers from the entrance end to the exit end of the oven structure;

a plurality of spaced-apart, elongated reflector guides suspended from and attached to each bridge member, the reflector guides extending transverse to the line of the rollers and parallel to each other; and a plurality of removably insertable, radiant heat-generating lower emitters interspersed among the rollers and extending between the oven structure transverse and below the linearly conveyed workpiece, the emitters adapted for heat treating the material by directing radiant heat upon the material.

13. The oven unit of claim 12 wherein the lower emitters are attached to each opposed side of the oven structure and are adapted for vertically adjustable movement to or away from the workpiece.

14. The oven unit of claim 13 wherein the lower emitters are positioned at least one-half inch away from the workpiece when the workpiece is being conveyed through the oven unit.

15. The oven unit of claim 12 further comprising a plurality of removably insertable reflector housings extending transverse to the line of the rollers and above the workpiece conveyed thereon, each reflector housing adapted for slidable insertion onto each respective reflector guide.

16. The oven unit of claim 15 further comprising a plurality of cambered, removably insertable, heat reflective panels with each panel mounted within each respective reflector housing, the panels adapted for reflecting radiant heat onto the material for facilitating heat treating of the material.

17. The oven unit of claim 12 further comprising a plurality of upper emitters interspersed among the reflector housings and extending transverse and above the linearly conveyed workpiece, the upper emitters attached to each respective bridge member and adapted for directing radiant heat onto the material for heat treating the material.

18. The oven unit of claim 17 wherein the upper emitters are adapted for vertically adjustable movement to or away from the workpiece being linearly conveyed on the rollers.

19. The oven unit of claim 17 wherein the upper emitters are adapted for horizontally adjustable movement along the length of each bridge member above the linearly conveyed workpiece.

* * * * *